US011034559B2

(12) United States Patent
Vanden Avond

(10) Patent No.: US 11,034,559 B2
(45) Date of Patent: Jun. 15, 2021

(54) PORTABLE PULLING DEVICE AND METHOD THEREOF

(71) Applicant: Mark Vanden Avond, Denmark, WI (US)

(72) Inventor: Mark Vanden Avond, Denmark, WI (US)

( * ) Notice: Subject to any disclaimer, the term of this patent is extended or adjusted under 35 U.S.C. 154(b) by 65 days.

(21) Appl. No.: 16/697,659

(22) Filed: Nov. 27, 2019

(65) Prior Publication Data

US 2020/0172382 A1 Jun. 4, 2020

Related U.S. Application Data

(60) Provisional application No. 62/773,022, filed on Nov. 29, 2018.

(51) Int. Cl.

| | |
|---|---|
| ***B66D 3/00*** | (2006.01) |
| ***B66D 1/36*** | (2006.01) |
| ***B66D 1/14*** | (2006.01) |
| ***B66D 1/60*** | (2006.01) |
| ***B66D 1/42*** | (2006.01) |

(52) U.S. Cl.

CPC ..... *B66D 3/006* (2013.01); *B66D 1/14* (2013.01); *B66D 1/36* (2013.01); *B66D 1/42* (2013.01); *B66D 1/60* (2013.01)

(58) Field of Classification Search

CPC ... B66D 1/14; B66D 1/36; B66D 1/42; B66D 1/60; B66D 3/006; B65H 75/4407

See application file for complete search history.

(56) References Cited

U.S. PATENT DOCUMENTS

| | | | | | |
|---|---|---|---|---|---|
| 2,595,655 | A * | 5/1952 | Hannay | B65H 75/4486 | 242/390 |
| 2,647,699 | A * | 8/1953 | Bush | B65H 51/14 | 242/564.3 |
| 3,054,572 | A * | 9/1962 | Williams | H02G 1/04 | 242/419.9 |
| 3,520,514 | A * | 7/1970 | Evans | B66C 19/02 | 248/163.2 |
| 4,588,167 | A | 5/1986 | Finzel | | |
| 4,650,163 | A * | 3/1987 | Peterson | B66D 1/00 | 254/327 |
| 4,754,825 | A * | 7/1988 | Scheffer | A01M 31/00 | 104/173.2 |
| 5,273,257 | A * | 12/1993 | Perkins | B66D 1/18 | 254/323 |
| 5,275,452 | A | 1/1994 | Cleveland | | |
| 5,330,122 | A * | 7/1994 | Wood | B65H 54/2821 | 242/397.3 |
| 5,374,035 | A | 12/1994 | Santos | | |
| 6,024,318 | A * | 2/2000 | Barry | A01K 97/01 | 242/396.9 |

(Continued)

*Primary Examiner* — Michael E Gallion

(74) *Attorney, Agent, or Firm* — Brandon Carlin

(57) ABSTRACT

A portable pulling device and method therefore, the portable pulling device including a chassis frame, a power source, anchoring elements, a spool, a rope or cable attached thereon, and a centrifugal clutch with a chain or belt drive system allowing the ability to pull out the rope when the power source is at idle. The device further contains frame propulsion components such as wheels, skis, or tracks to facilitate movement of the pulling device into and through a confined area such as a forest or a barren area.

20 Claims, 7 Drawing Sheets

(56) References Cited

U.S. PATENT DOCUMENTS

| | | | | |
|---|---|---|---|---|
| 7,419,137 | B2 * | 9/2008 | Boon | B65H 75/425 242/397.3 |
| 7,913,978 | B1 | 3/2011 | Trihey | |
| 8,616,529 | B2 * | 12/2013 | Kim | B66D 1/39 254/385 |
| 9,918,437 | B2 * | 3/2018 | Spencer | A01G 23/062 |
| 10,815,102 | B2 * | 10/2020 | Dodd | B66D 3/26 |
| 2012/0187355 | A1 * | 7/2012 | Mehrkens | A63C 11/10 254/222 |
| 2014/0084229 | A1 | 3/2014 | Morrison | |
| 2019/0177136 | A1 * | 6/2019 | Soderberg | B66D 3/006 |
| 2019/0210846 | A1 | 7/2019 | Lulfing | |

* cited by examiner

PORTABLE PULLING DEVICE AND METHOD THEREOF

CROSS REFERENCE TO RELATED APPLICATION

This application claims the benefit of U.S. Provisional Application 62/773,022, filed Nov. 29, 2018.

FIELD

The present invention is directed to the field of pulling devices, and more particularly to a portable cable and/or nylon rope pulling device. The present invention is also directed to a series of functions that may be performed to pull an object out of a confined or barren area without the use of a third-party counterweight.

INTRODUCTION

When a person desires to physically move an excessively dense object to an alternate location, the person typically must use pushing or pulling force. However, it is known that there exist multiple forces which counteract the moving object, such as gravitational and frictional forces. Frictional force is the resistance to motion of one object relative to another object. This frictional force is the force exerted by a surface as an object attempts to move across it, and different surfaces provide varying frictional force magnitudes that must be overcome. Thus, an object may be easily slid on a smooth surface but moving the same object may be arduous on a rough terrain surface.

When attempting to move a heavy object in a varying terrain such as the outdoors, a number of factors can magnify the already difficult task of moving the object, such as the presence of trees, rocks, sloped terrain, and the like. Not only does the surface of the ground provide frictional resistance, but downed trees, rocks, and sloped terrain are some examples of burdens which may require the object to be lifted as well as pulled or pushed to overcome these vertical encumbrances.

These difficulties cause great concerns for persons in the outdoors that desire to move heavy objects such as a medium to large game animal that has been successfully hunted. For example, a white-tailed deer is an animal that weighs approximately 150 pounds, a black bear can weigh around 400 pounds, elk frequently weigh 700 pounds, and moose typically weigh upwards of 1,000 pounds. These weights are generally too excessive for the average person to be able to lift and/or move on their own without assistance, and this excessive weight combined with the additional frictional force is only exacerbated by the constricted nature of a forest which is the typical place to hunt some of these animals.

One current method used is a rope tied around an animal's neck to provide dragging assistance. A hunter can then drag the animal through the forest to a location not as constricted whereupon they can load the animal onto a vehicle such as a truck or an ATV. These vehicles are not able to get into dense forest and up or down some slopes. Typically, hunters must take breaks every so often to catch their breath as this process is exerting and the hunter is generally wearing a lot of clothing to protect against the elements, such as cold weather. This process is quite a burden as a downed animal can be a mile or more from an area that a vehicle may enter when the animal is recovered. Additionally, larger animals may be too much weight to overcome even with the rope assistance.

Another method, used in combination with the above, is to call other persons to the hunter's location. These other persons can either alternate turns dragging the animal or may tie additional ropes around the neck in order to provide additional pulling force on the animal. The same limitations as above apply, and the process is not ideal.

A third method used is to begin quartering the animal in the field. This is a process where the animal is cut into smaller, more manageable pieces, and the individual pieces are then dragged or carried out. The issues with this method are that multiple trips must be taken, the process is a lengthy one, and scavenger animals may begin to move in on the hunted animal while the hunter is walking to the vehicle and before returning for the other sections.

What is needed, therefore, is a portable device which can be brought into a close quarters such as a forest which can also reduce the burden on a person pulling an object such as a hunted animal carcass, a felled tree, or other object in a timely and convenient method.

BRIEF SUMMARY

The present invention is directed to a portable pulling device that provides a pulling force to assist with the movement of heavy objects. A preferred portable pulling device constructed in accordance with the present invention is not only well suited for traversing constricted areas but can also be used to emit a powerful pulling force upon a heavy object so as to facilitate the movement of said object from one location to another. The portable pulling device contains anchoring elements, such that no additional counterweight such as a tree, building, or vehicle is required.

The portable pulling device chassis frame has a power source attached to the frame, and the power source utilizes a centrifugal clutch. Therefore, the pulling device is different than a typical winch, in that the pulling device of the present invention contains no gearbox or gear train. The centrifugal clutch utilizes a drivetrain such as one that is a chain-driven or belt-driven drivetrain. The mechanical power created by the power source is conveyed from the drivetrain to a spool, reel, or shaft whereupon a cable or synthetic rope is attached. The cable or rope may contain an additional rope attachment method or device to facilitate encircling an object desired to be pulled. The rope attachment method may be as simple as tying the rope around an object but may alternatively consist of an additional device such as a carabiner, d-clip, clamp, or hook.

The power source has an output shaft, which operates as, or similar to, a crankshaft and which provides rotational motion. The output shaft is generally mated with a centrifugal clutch, and the centrifugal clutch possesses or is mated with a drive sprocket. The drive sprocket moves in tandem with a rear sprocket on the spool drum by way of a roller chain or belt, thus creating the drivetrain. As the drive sprocket is activated, the rear wheel sprocket and spool are activated as well by way of the roller chain acting on these pieces. The drive sprocket, the rear wheel sprocket, and the roller chain all together are known and defined herein as the drivetrain.

For ergonomic efficiency, a handle shaft may be attached to the device with a handlebar. The handle shaft may be a single handle shaft or may be multiple handle shafts, such as to form a dual handle shaft. The handlebar is presently thought to be a straight line bar, but it may be contoured for ergonomics, such as a track drop bar, drop handlebar, bullhorn handlebar, or any shape desired. The handle shaft is connected to the chassis frame by way of a carrying handle connection point on the outer frame edge. The outer frame edge is known as the portion of the chassis frame where the handle shaft is attached. The connection of the handle shaft to the chassis frame may be attached in many fashions, such as welded, bolted, fastened, or otherwise attached.

Located on or near the handlebar, a throttle handle is provided. The throttle handle utilizes a throttle cable, which is an attachment braid or cable that connects the throttle handle to the power source by way of a throttle cable connection point. The throttle handle controls the activation of the power source by regulating the fuel or air to the power source. When the power source is turned on, and when the throttle is not engaged, the power source is generally at idle. When the throttle is engaged, the power source activates and reacts with the output shaft and the centrifugal clutch to provide rotational movement on the drivetrain. When the throttle is so engaged, the spool is rotating, and the rope is being retracted. To halt the retraction of the rope, the user releases the throttle handle.

It is desired that the device is able to traverse a constricted area such as a forest or any area without roads with ease, and thus the device has frame propulsion components, such as wheels, skis, or tracks for example. Skis are an option when the device is to be used in a snowy environment, and wheels are also contemplated as a practical and cost-effective method. However, in some embodiments, a user might desire to use tracks for the better weight distribution provided, and when there are soft or slippery conditions. Any of the above propulsion may be used in an embodiment of the present invention.

The chassis frame itself may be constructed of any material or in any shape desired, so long as it is able to support the power source, but preferably is a size and shape that is the least restrictive in terms of size and overall weight, while still maintaining the strength and durability desired. The chassis frame may be made of a durable material such as steel, carbon steel, aluminum, iron, polyvinyl chloride, or any other durable material. The power source is attached to the frame with power source frame attachments. This is presently thought to be a fastener, such as bolts, nuts, or screws, though any sturdy fastening method is appropriate.

As stated above, the spool contains a rope or cable connected or wound thereon. This cable or rope can be fed out and given slack when the power source is at idle due to the centrifugal clutch being in an idle position as the throttle is not at that moment engaged. The cable or rope can then be attached to the object desired to be moved, and the power source, when the throttle is activated, provides mechanical power through the drivetrain to the spool that retracts the cable or rope, and thus the object.

It is known that a cable may be more durable and longer lasting than a synthetic rope, but the cable is also heavier than a rope, can rust, and may be difficult to handle due to kinetic energy storage, and barbs, among other issues. The synthetic rope can be easier to handle, lighter weight, and less maintenance, but it can be susceptible to freezing, and debris buildup, along with abrasion and other potential issues. According to the particularities of the desired object to be pulled and the location of the pulling device as well, either option is able to be utilized with the present device and the terms are used interchangeably herein.

It is contemplated that while the power source may be of a number of different sources, a small gasoline engine may be used to reduce the weight of the device itself, as opposed to an electric motor which would require the need for a heavy battery. However, other power source types such as petroleum, alcohol, natural gas, hydrogen, or the like may be used to power the drivetrain without departing from the spirit of the present invention. The power source may be a larger engine when an objective is to pull an extremely heavy object that a smaller embodiment with a smaller engine could not pull. Electrical power of the device may come by way of a stator located on or near the power source, should the user desire to have electrical accessory items such as an luminescent light.

The centrifugal clutch is able to spin in one direction and can also be adjusted so as to spin in the opposite direction or be released in an idle position so as to be able to pull slack out of the line of the rope. This feature allows the user to let out slack on the cable or rope line while simultaneously moving in the desired direction that the user wishes the object to be moved. Once the line is let out a desired length, the user can activate the power source with the throttle, and the line will be retracted and wind on the device's spool, thereby pulling the object towards the pulling device itself. At this point the user can repeat and perform these steps again until the object has reached the desired final location.

The spool of the device, otherwise known as the drum, shaft, or reel, is presently contemplated to be generally cylindrical and spun by a chain or belt of the drivetrain which contacts a rear wheel sprocket located on or near the spool. The mechanical energy provided by the drivetrain induces the rotation of the spool itself through this rear wheel sprocket. The spool is mated on both ends by pillow blocks, which are pedestals which provide support for the spool to rotate and are attached to a front-facing frame, as described below.

The pulling device also contains at least one anchoring element in which to provide a counterweight to the object being pulled. Devices that contain no anchors require a counterweight to be used, such as the weight of a vehicle, or attachment to a stationary object such as a building or a tree. Naturally, it is difficult to find a stationary object such as above if a user is in a field, marsh, or other area where robust trees are not readily available and vehicles are not able to traverse. In such a scenario, a user might be tempted to use their own strength to be the counterweight. However, there is a safety concern if a user uses their own weight, as this requires the user to provide a lot of strength, depending on the size and weight of the pulled object.

The anchoring elements of the present invention may be any number of elongated posts attached to the front end of the front-facing frame such that the elongated posts are vertically positioned towards the ground. The attachment might be through any variety of methods, such as welding, bolts, or screws to name a few. These posts are presently contemplated to have a general shape as a three-dimensional trapezium, but may also be generally tubular, wheeled legs, or any-shaped heavy weight which contacts the ground or close thereto.

At the distal end away from the front-facing frame closest to the ground according to one preferred embodiment of the present invention exists a triangular edge which is capable of driving into the ground so as to provide the most counterweight for the pulling device. However, alternative methods are contemplated depending on the circumstances, the anchoring elements selected, or the location or climate where the device is to be used, such as an alternative to a triangular edge, heavy weights are positioned at the distal end of the anchoring elements, or any multitude of shapes as opposed to a triangular point such as a diamond, an arrow, a cone, a crescent, or the like, so long as said shape acts as an anchoring element to create the desired counterweight.

On a distal end of the chassis frame, opposite the handle shaft, is a front-facing frame. The front-facing frame is thought to be a strong frame which is attached to the chassis frame of the pulling device. The front-facing frame is presently thought to be generally perpendicular to the ground, at a generally right-angle to the chassis frame, and the component upon which the pillow blocks are attached. The front-facing frame need not be a true right-angle, and may be slightly acute or obtuse in angle, depending on the particularities of the device's intended use.

Additionally, it is contemplated that the angle of the front-facing frame may be adjustable in certain embodiments. The front-facing frame is attached to the chassis frame, or is a singular piece formed together with the chassis frame, depending on construction. In one embodiment, the front-facing frame attachment pieces are presently thought to be a type of fastener, such as bolts, nuts, screws, or welds, though any sturdy fastening method is appropriate. Presently it is thought that one method of constructing the front-facing frame is to use the same durable material that the chassis frame itself is constructed out of, though it may be alternatively constructed with any other durable material without departing from the spirit of the present invention.

The front-facing frame thus provides horizontal stability and a mounting location for the spool by way of the pillow blocks. To provide additional strength and stability, oblique support arms may be optionally provided, which are support pieces that provide additional strength to the front-facing frame and are attached to the chassis frame on one end, and to the front-facing frame on the other end.

These and various other features, advantages, modes, and objects of the present invention will be made apparent from the following detailed description and any appended drawings.

BRIEF DESCRIPTION OF THE FIGURES

One or more preferred exemplary embodiments of the invention are illustrated in the accompanying drawings in which like reference numerals represent like parts throughout and in which.

Before explaining one or more embodiments of the disclosed invention in detail, it is to be understood that this invention is not limited in its application to the details or modes of construction and the arrangement of the components set forth in the following description or previously disclosed illustrations. This invention is capable of multiple embodiments and modes, which can be practiced or carried out in many various ways. Also, it is to be understood that the phraseology and terminology employed herein is for the purpose of description, and should not be regarded as limiting, or used as an absolute.

DETAILED DESCRIPTION OF THE PREFERRED EMBODIMENT

Figure 1:
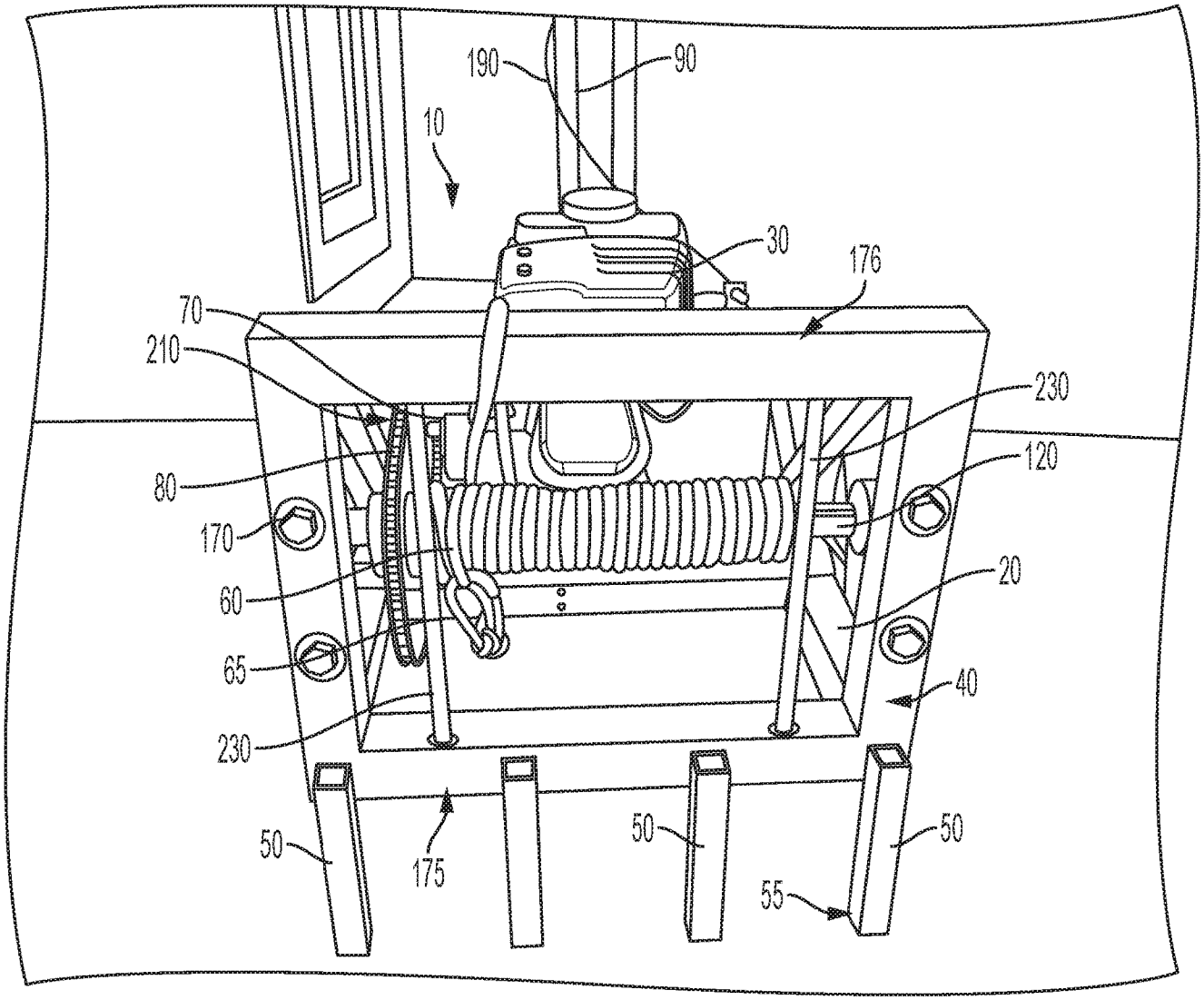
FIG. 1 is a perspective view of a preferred embodiment of the portable pulling device with the pulling device spool shown utilizing a synthetic rope.

Referring now to the drawings in detail, FIG. 1 illustrates a preferred embodiment of a portable pulling device 10 in accordance with the present invention that is a chassis frame 20 having a generally rectangular shape, and a power source 30 attached thereon.

Figure 3:
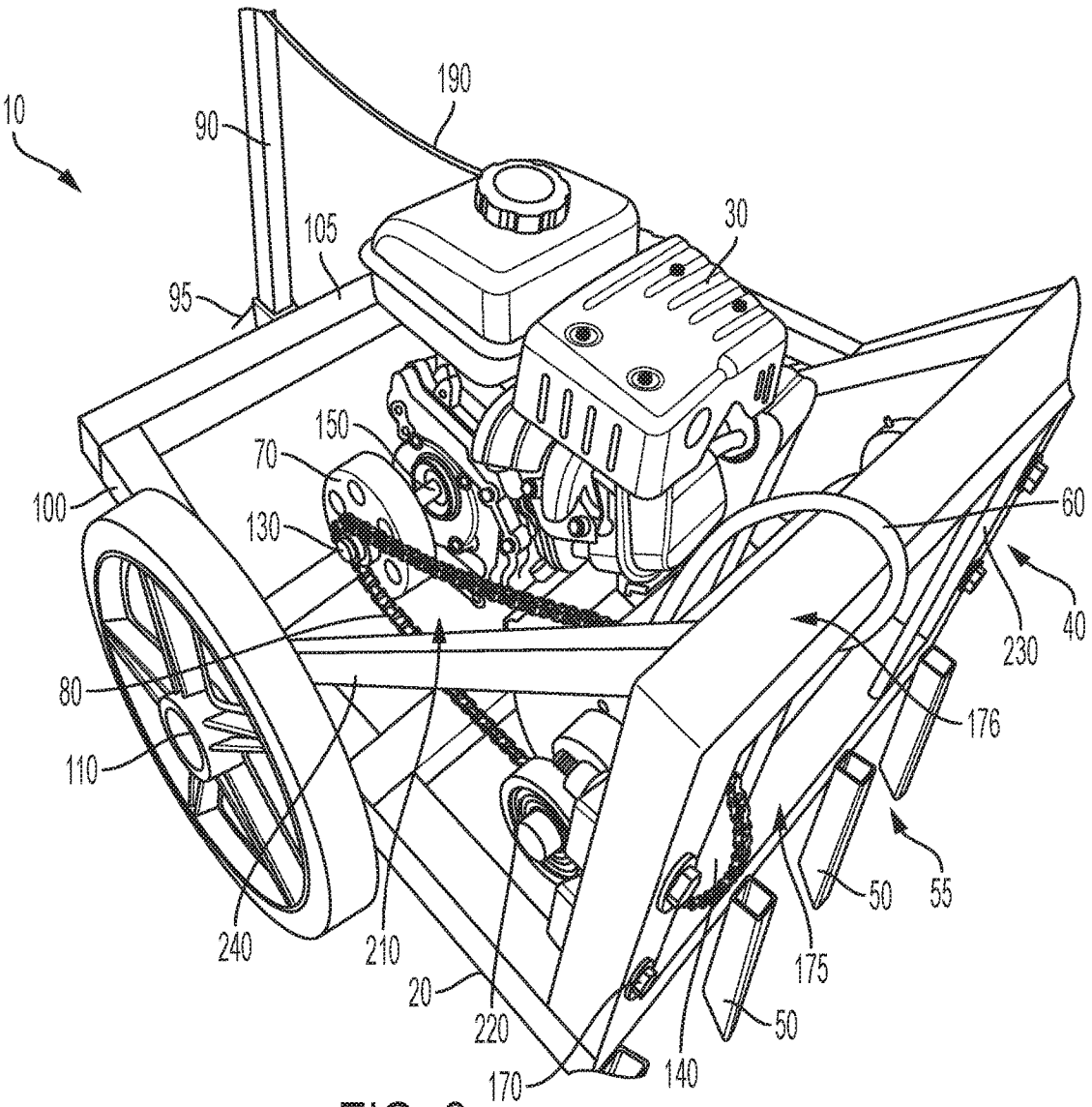
FIG. 3 is a perspective view of a preferred embodiment of the portable pulling device showing a chain drivetrain.
Figure 4:
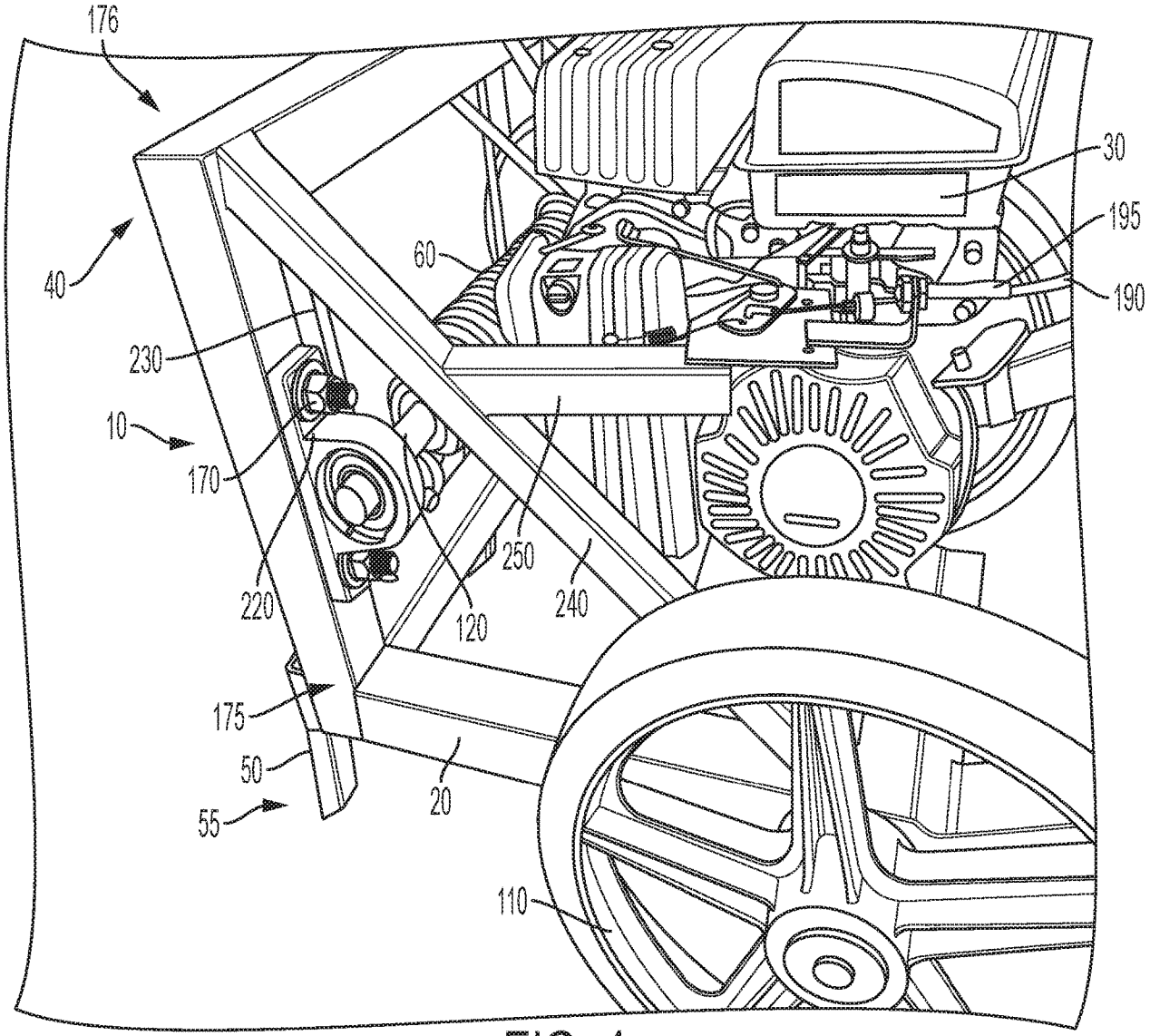
FIG. 4 is a side-perspective view of a preferred embodiment of the portable pulling device.

The device spool 120 as shown here is generally cylindrical, and a cable, or in this particular embodiment, a rope 60, is wound thereon. A rear wheel sprocket 140 is attached near a distal end of the pulling device spool 120, and both ends of the pulling device spool 120 are mated with a pillow block 220 (as shown in FIG. 3 and FIG. 4).

The pillow blocks 220 are attached to a front-facing frame 40 by way of front-facing frame attachments 170 to provide stability. The front-facing frame 40 of the embodiment of the present invention shown here is a rectangular chassis with equilibrium guide bars 230, which assist in the winding of the rope 60 upon the spool 120, such that the rope 60 does not get wound cattywampus or otherwise improperly interact with the rear wheel sprocket 140.

The rope 60 on the spool 120 may additionally contain a rope attachment device 65, which is a device used to surround the object with the rope 60. The rope attachment device 65 as shown here is a carabiner, otherwise known as a d-clip, but may be any other type of attachment method or device as described above.

The front-facing frame 40 of the present invention further includes anchoring elements 50, attached to the front-facing frame front edge bottom 175, wherein said anchoring elements 50 are shown in this embodiment as generally vertical posts containing a triangular point 55 at a distal end. These triangular points 55 interact with the ground, so as to provide a counterweight to the pulling action of the device 10 on the object desired to be pulled.

The front facing frame 40 is attached to the chassis frame 20 by way of oblique support arms 240, as shown in FIGS. 3 and 4. The front facing frame 40 may be positioned at a generally right-angle to the chassis frame 20, such as shown, though it may be positioned at an acute or obtuse angle, depending on the location and desired use of the pulling device 10.

Figure 2:
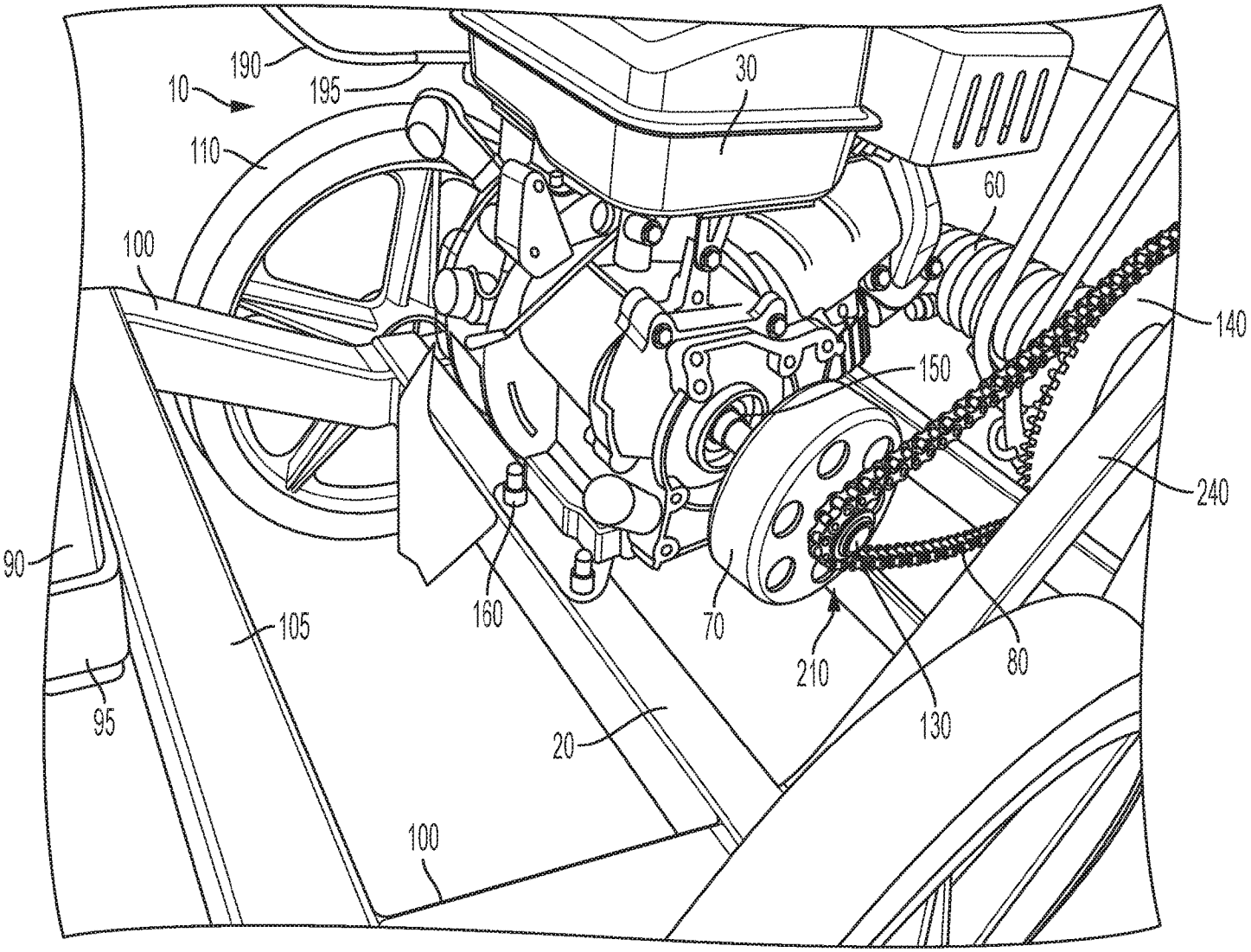
FIG. 2 is a second perspective view of a preferred embodiment of the portable pulling device and the power source therefore.

Turning now to FIG. 2, the power source 30 of the portable pulling device 10 is shown. The power source 30 shown here is a small gasoline engine which is attached to the chassis frame 20 by way of power source frame attachments 160. While the power source 30 may be welded or otherwise formed into the chassis frame 20 itself, here the power source frame attachments 160 are bolts.

On the end of the chassis frame 20 opposite that of the front-facing frame 40, a carrying handle shaft 90 may be attached to the chassis frame 20 on a carrying handle connection point 95 located on the outer frame edge 105. This carrying handle shaft 90 helps to support the carrying handlebar 200 (shown in FIG. 5) and assists the user in moving the portable pulling device 10 itself, as will be described in detail below.

The power source 30 as shown in this embodiment is a gasoline engine which is coupled to a drivetrain 210 by way of an output shaft 150 (as shown in FIG. 2). The output shaft 150 is combined with a centrifugal clutch 70 which is connected to the drive sprocket 130 which interacts with a rear wheel sprocket 140 by way of a roller chain 80 to form a drivetrain 210.

The drivetrain 210 moves the spool 120 and retracts the rope 60 when the throttle handle 180 (shown in FIG. 5) is engaged. The centrifugal clutch 70 and the spool 120 are not activated until the power source 30 provides power to the output shaft 150, such that the rope 60 may be released from the spool 120 by pulling on the rope 60 itself in a direction away from said spool 120.

Once the throttle handle 180 (shown in FIG. 5) is activated, and provides power to the power source 30 by way of the throttle cable 190 coupled to the power source 30 at a throttle cable connection point 195, the power source 30 provides power to the output shaft 150, the centrifugal clutch 70 activates, and the drivetrain 210 provides rotational torque to the spool 120 such that the rope 60 is retracted back into position on the spool 120.

To move the portable pulling device 10, a user produces downward force on the carrying handlebar 200 (shown in FIG. 5), which induces the anchoring elements 50 and the triangular points 55, if any, to release contact with the ground, and the chassis frame 20 to be diagonal when juxtaposed with a flat ground, such that the outer frame edge 105 is nearer to the ground than the front-facing frame front edge bottom 175. When this is done, the user may produce a force on the carrying handlebar 200 (shown in FIG. 5), in a side direction or in a pushing or pulling motion so as to move the portable pulling device 10 by way of the frame propulsion components, such as skis, tracks, or wheels 110 in the direction of the horizontal force applied. Another optional provisional is the attachment of a foot placement deck 106 (shown in FIG. 6) attached to the outer frame-edge 105. A user may place their foot on the foot placement deck 106, to coincide with the downward force applied on the carrying handlebar 200 as described above.

The chassis frame 20 in this preferred embodiment of the present invention shows optional vertical slopes 100 which provide a height element to the chassis frame 20 of the portable pulling device 10 when viewed from the side as in this figure. The outer frame edge 105 can impact the ground when the user is moving the portable pulling device 10 as described above, and the vertical slopes 100 provide additional clearance for the outer frame edge 105 as to the ground when the portable pulling device 10 is being moved.

Moving now to FIGS. 3-4, a preferred embodiment of the portable pulling device 10 constructed in accordance with the present invention is shown from alternate side perspective views. As is made clear, the pulling device 10 is resting on the wheels 110 and the anchoring elements 50. The anchoring elements 50 may contain additional weight at the distal end contacting the ground, or it may have sharpened edges, such as the triangular points 55 as is shown in this embodiment. These anchoring elements 50 provide that the weight of the pulling device 10 itself is the counterweight that allows the portable pulling device 10 to not be required to strap down to a tree or vehicle while the rope 60 is being retracted and the pulling device 10 is in operation with a pulled object.

It is contemplated herein that the anchoring elements 50 may alternatively be connected to the front-facing frame edge bottom 175 as well as the front-facing frame front edge top 176 and thus be dual-purpose acting additionally as equilibrium guide bars 230.

The chassis frame 20 as shown is generally rectangular, but it is contemplated herein that the frame may be constructed in any general shape such as an oval, a triangle, a circle, or any quadrilateral while adhering to the spirit of the invention as disclosed herein. The power source 30 is located on top of the chassis frame 20 and between the carrying handle shaft 90 and the front-facing frame 40. As described above, the pillow blocks 220, which couple with the device spool 120 are attached to the front-facing frame 40 by way of front-facing frame attachments 170 as shown from alternative sides in FIGS. 3-4.

To provide supplemental stability to the front-facing frame 40, oblique support arms 240 may be utilized, which are generally support rods connected to the front-facing frame 40 on one end, and to the chassis frame 20 on the opposite end.

Additionally, a frame guide arm 250 may be provided and positioned as one optional method is shown in FIG. 4, whereupon parts of the power source 30 can be positioned, such as the throttle cable connection point 195. This frame guide arm 250 thus provides additional stability to the power source 30 components.

Figure 5:
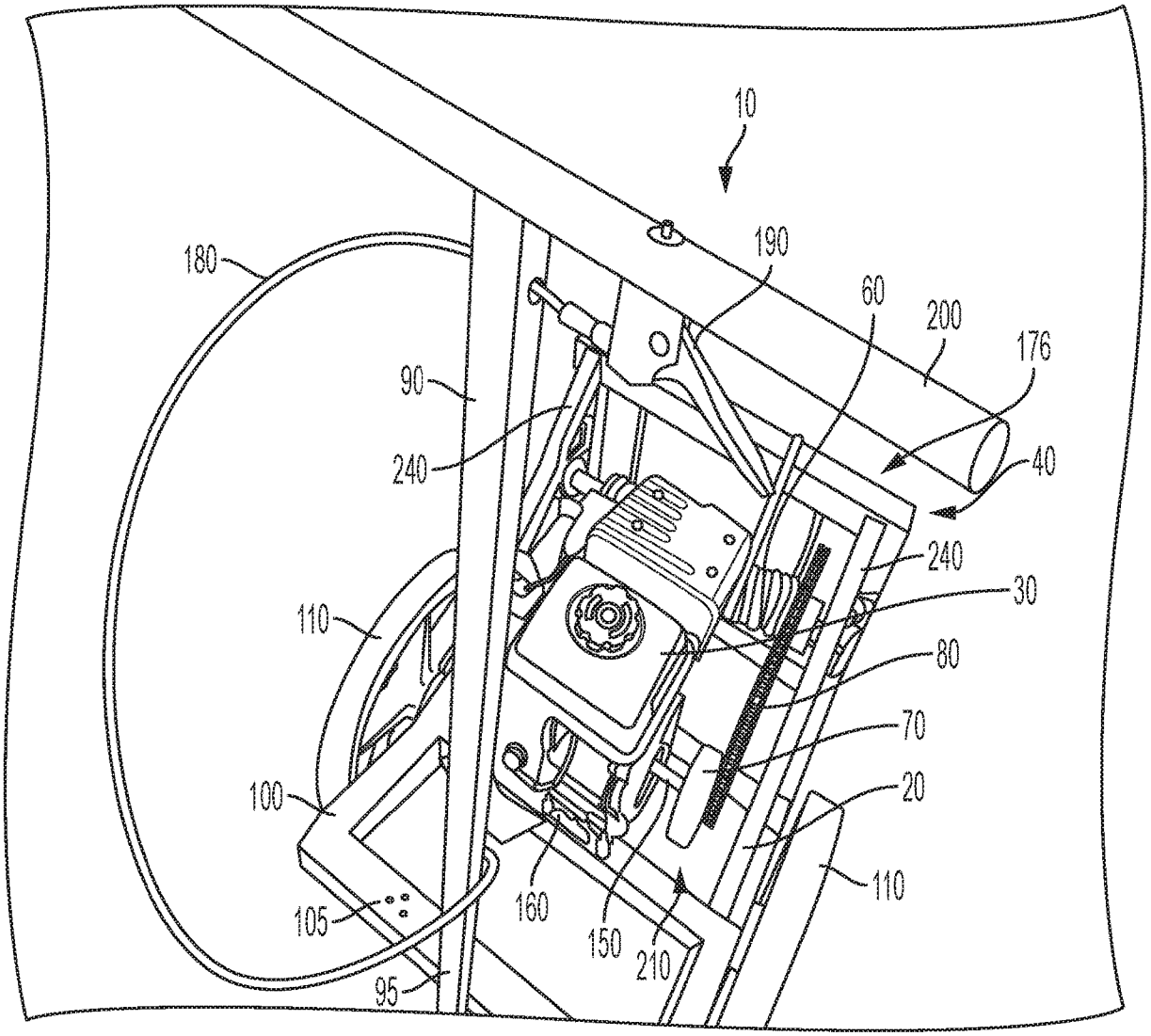
FIG. 5 is a vertical perspective view of a preferred embodiment of the portable pulling device where the device utilizes a handle and a throttle thereon.

In FIG. 5 a vertical top-down perspective view of a preferred embodiment of the portable pulling device 10 is shown. The carrying handle shaft 90 is connected to a carrying handlebar 200. The carrying handlebar 200 as shown here is coupled with a throttle handle 180 which is coupled to a throttle cable 190. The throttle cable connects to the power source 30 by way of a throttle cable connection point 195, as shown in FIGS. 2 and 4.

Figure 6:
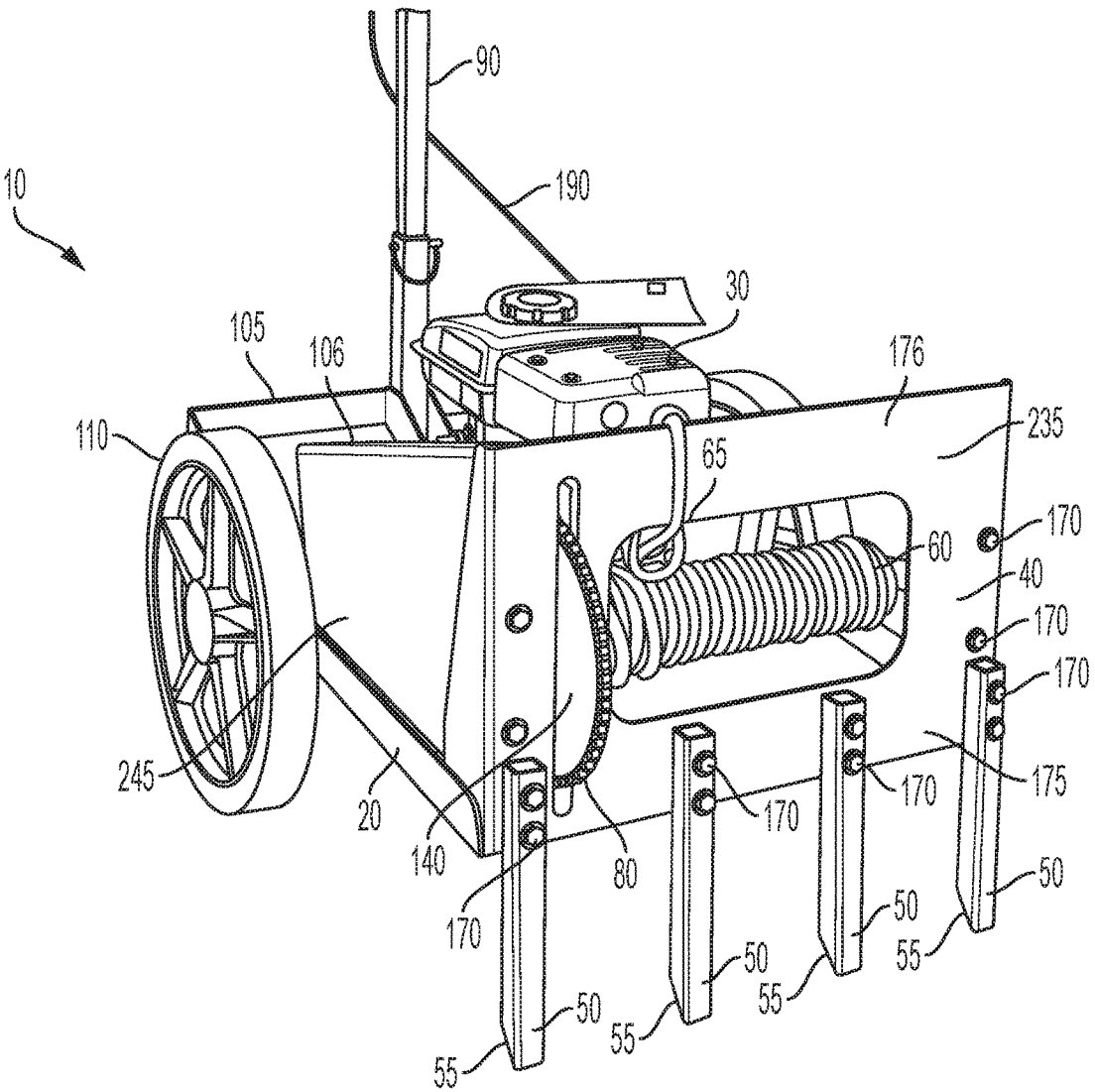
FIG. 6 is a perspective view of a preferred embodiment of the portable pulling device wherein a front shield wall and an oblique side wall is provided.

Looking at FIG. 6, an embodiment of the present disclosure is shown, wherein the portable pulling device 10 is shown where the equilibrium guide bars 230 are covered by an optional front shield wall 235, which is a cover around or approximately around the front-facing frame 40, so designed to prevent debris from ingressing the portable pulling device 10, or the rear wheel sprocket 140. Also shown are the anchoring elements 50 attached to or around the front-facing frame 40 or the front-facing frame front edge bottom 175 by way of optional front-facing frame attachments 170. In this embodiment shown here, the oblique support arms 240 are covered and shielded by way of an optional oblique side wall 245, which is a cover designed to prevent debris or obstructions from ingressing the portable pulling device 10.

Figure 7:
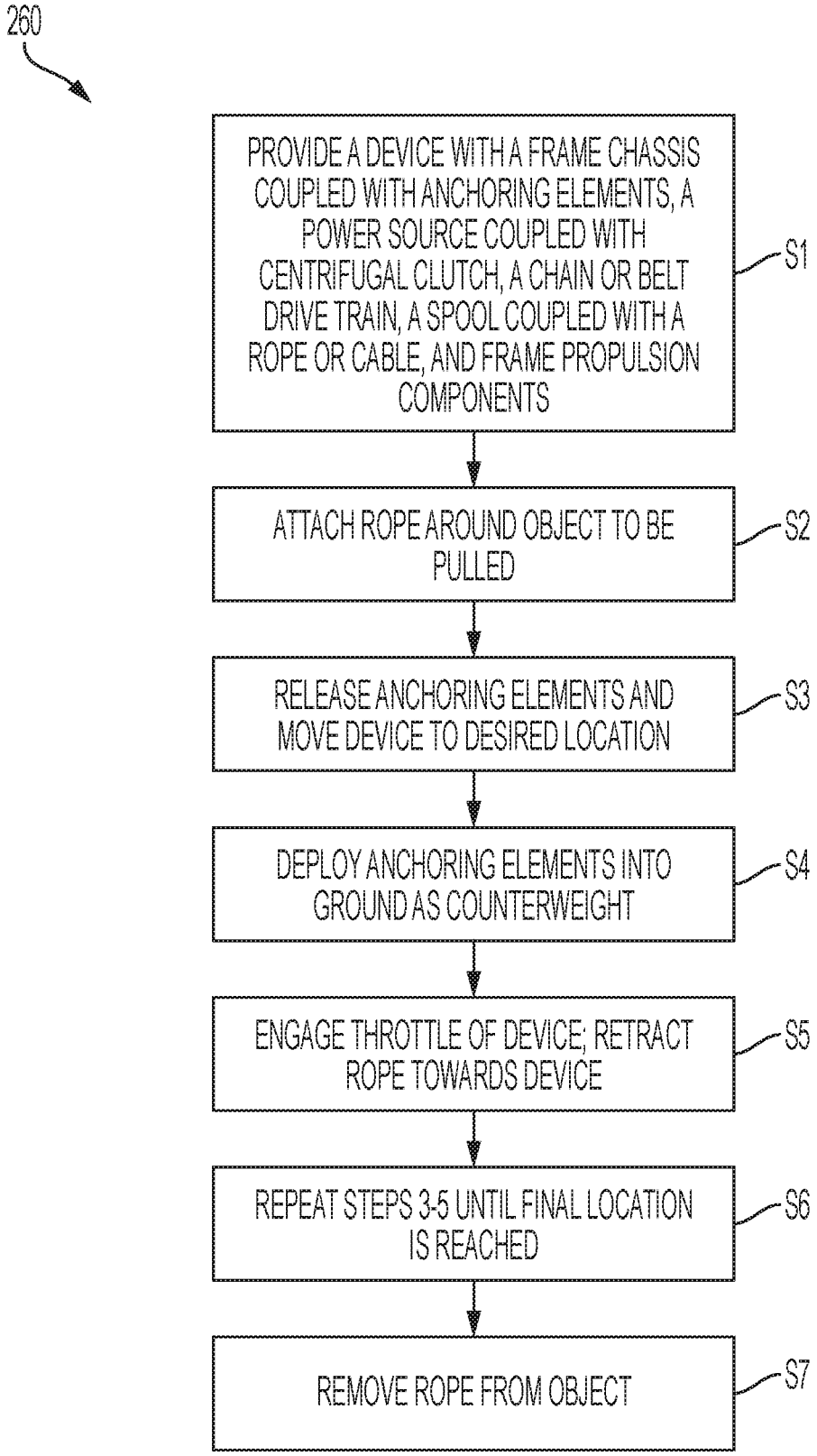
FIG. 7 illustrates a method to pull an object in accordance with some embodiments of the present invention.

A method for pulling an object 260 out of a confined or barren area is depicted in FIG. 7. Those with skill in the art will understand that this method for pulling an object 260 can be performed in various orders and arrangements, rearranging the steps as illustrated herein, and adding some additional actions, and further knowing that some steps are not necessary in particular circumstances.

This method for pulling an object 260 generally commences upon the action S1 of providing a portable pulling device 10. In currently preferred embodiments, the portable pulling device 10 has a frame chassis 20, anchoring elements 50, a power source 30, a centrifugal clutch 70, a rope 60 or cable attached to a spool 120, and frame propulsion components such as skis, tracks, or wheels 110.

The method for pulling an object 260 further includes the action S2 of attaching the rope 60 around the object desired to be pulled or moved, by way of tying the rope, or using a rope attachment device 65 as described above.

After attaching the rope 60 to the object, or surrounding the object with the rope 60, the carrying handlebar 200 is tilted toward the ground, causing the frame chassis 20 to be diagonal to the ground, whereupon the anchoring elements 50 are released, and the portable pulling device 10 is pushed or pulled and moved to a desired location S3.

Once in location, the anchoring elements 50 reengage the ground S4 as the frame chassis 20 is put back in a generally parallel to the ground position, whereupon the portable pulling device 10 provides a counterweight.

Once in position and with the portable pulling device 10 acting as a counterweight, the throttle handle 180 is engaged S5, and the power source 30 activates, which causes the centrifugal clutch 70 and drivetrain 210 to provide rotation torque on the spool 120, thereby retracting the rope 60, and thus the object, towards the portable pulling device 10.

After the object is brought towards the desired location, the user may repeat steps 3-5 if necessary, until the object is in the final desired location S6. At this point, remove the rope from the object S7.

Understandably, the present invention has been described above in terms of one or more preferred embodiments and methods. It is recognized that various alternatives and modifications may be made to these embodiments and methods that are within the scope of the present invention. It is also to be understood that, although the foregoing description and drawings describe and illustrate in detail one or more preferred embodiments of the present invention, to those skilled any art to which the present invention relates, the present disclosure will suggest many modifications and constructions, as well as widely differing embodiments, applications and methods without thereby departing from the spirit and scope of the invention.

What is claimed is:

1. A portable pulling device, comprising:

a frame having a front end, a rear end, and a plurality of side ends each having a first end and a second end;

a power source mounted on the frame;

an output shaft connected to the power source, said output shaft comprising a centrifugal clutch and a drive sprocket;

a handle shaft connected to the rear end of the frame, said handle shaft extending vertically away from the frame;

a front facing frame having a top edge, a bottom edge, a first side wall, and a second side wall, the front facing frame attached to the front end of the frame;

an anchoring element having a top end and a bottom end, the anchoring element attached to the bottom edge of the front facing frame;

a spool having distal ends, said spool positioned between the first side wall and the second side wall of the front facing frame, wherein said spool is capable of winding and unwinding a rope;

a rear wheel sprocket attached to the spool; and propulsion components attached to the plurality of side ends of the frame.

2. The portable pulling device of claim 1, further comprising the anchor being a plurality of anchoring elements attached to the bottom edge of the front facing frame.

3. The portable pulling device of claim 2, wherein the plurality of anchoring elements further comprise triangular points on the bottom edges thereof.

4. The portable pulling device of claim 3, wherein an equilibrium guide bar is provided, the equilibrium guide bar attached to the top edge of the front facing frame and further attached to the bottom edge of the front frame.

5. The portable pulling device of claim 4, wherein a front shield wall is provided, said front shield wall attached to front facing frame.

6. The portable pulling device of claim 5, wherein the propulsion components are wheels.

7. The portable pulling device of claim 6, wherein a foot placement deck is provided at a position between the frame side ends.

8. The portable pulling device of claim 7, further comprising a rope attached to the spool, said rope having a rope attachment device thereon.

9. The portable pulling device of claim 8, wherein a roller chain is provided which contacts with the rear wheel sprocket and the drive sprocket.

10. A portable pulling device, comprising:

a frame having a front end and a rear end;

a plurality of vertically sloped side walls connecting the front end and the rear end of the frame;

an engine mounted on the frame;

a front facing frame having a front face, a rear face, a top edge, a bottom edge, a first side wall, and a second side wall, the front facing frame attached at the bottom edge to the front end of the frame;

a first pillowblock attached to the rear face of the first side wall of the front facing frame, and a second pillowblock attached to the rear face of the second side wall of the front facing frame;

a spool having distal ends, said spool coupled to the first pillowblock and the second pillowblock;

a handle shaft having a top end and a bottom end, the handle shaft connected to the rear end of the frame at the bottom end thereof, said handle shaft extending vertically away from the frame;

a horizontally extending handlebar attached to the top end of the handle shaft;

a throttle cable having a first end and a second end, the throttle cable coupled at the first end to the engine;

a throttle handle coupled to the second end of the throttle cable;

an anchoring element having a top end a bottom end, the anchoring element attached to the front facing frame;

an output shaft connected to the power source, said output shaft comprising a centrifugal clutch and a drive sprocket;

a rear wheel sprocket attached to the spool;

a roller chain coupled to the rear wheel sprocket and additionally coupled to the drive sprocket; and propulsion components attached to the plurality of side ends of the frame.

11. The portable pulling device of claim 10, further comprising a rope attached to the spool, said rope having a rope attachment device thereon.

12. The portable pulling device of claim 11, wherein the anchoring element further comprises a triangular point on the bottom end thereof.

13. The portable pulling device of claim 12, wherein the propulsion components are one of wheels, skis, and tracks.

14. The portable pulling device of claim 13, further comprising the anchor being a plurality of anchoring elements.

15. The portable pulling device of claim 14, further comprising side walls connected to the front facing frame and extending directionally away from said front facing frame.

16. The portable pulling device of claim 15, wherein the engine is a combustible engine.

17. The portable pulling device of claim 16, further comprising a front facing shield wall attached to the front facing frame.

18. The portable pulling device of claim 17, further comprising a luminescent light.

19. A method for transporting an object from a first location to a second location, comprising the steps of:

providing a portable pulling device having a frame chassis, and a front facing frame attached to the frame chassis;

providing a power source mounted on said frame chassis;

providing a throttle cable having a first end and a second end, the throttle cable attached to the power source on the first end;

providing a throttle handle coupled to the throttle cable on the second end;

providing a centrifugal clutch coupled to the power source, and a chain drive train coupled to the centrifugal clutch;

providing a handle having a handlebar to the frame chassis;

providing a spool with a rope for the alternate winding and dewinding of the rope;

the spool being mounted to the front facing frame;

providing anchoring elements on the front facing frame;

affixing the rope around an object to be pulled;

releasing the clutch;

applying downward force on the handlebar, releasing the anchoring elements from contact with the ground;

moving the portable pulling device to a second position;

deploying the anchoring elements into the ground as a counterweight;

engaging the throttle handle and spool, retracting the rope towards the spool;

releasing the throttle handle when the object is near the second position; and removing the rope from the object.

20. The method of claim 19 wherein the power source is a combustible engine.

* * * * *